US005657540A

United States Patent [19]

Regenberg

[11] Patent Number: 5,657,540

[45] Date of Patent: Aug. 19, 1997

[54] METHOD OF AND TOOL FOR DISMOUNTING AND MOUNTING OF ROLLER RING

[75] Inventor: Wolfgang Regenberg, Krefeld, Germany

[73] Assignee: Kocks Technik GmbH & Co., Hilden, Germany

[21] Appl. No.: 511,551

[22] Filed: Aug. 4, 1995

[30] Foreign Application Priority Data

Sep. 9, 1994 [DE] Germany ..... 44 32 084.1

[51] Int. Cl.[6] ..... B23P 15/00

[52] U.S. Cl. ..... 29/895.1; 29/895.213; 29/244; 29/252; 29/402.08

[58] Field of Search ..... 29/895.1, 895.21, 29/895.213, 244, 402.08, 252

[56] References Cited

U.S. PATENT DOCUMENTS

| | | | |
|---|---|---|---|
| 3,831,242 | 8/1974 | Oxlade | 29/895.21 |
| 3,833,982 | 9/1974 | Paulin | 29/895.21 |
| 4,030,183 | 6/1977 | Smola | 29/244 |
| 4,961,261 | 10/1990 | Kojima et al. | 29/895.21 |
| 5,026,956 | 6/1991 | Busch | 29/244 |
| 5,406,706 | 4/1995 | Nagai | 29/895.21 |
| 5,442,854 | 8/1995 | Koltookian et al. | 29/244 |

FOREIGN PATENT DOCUMENTS

| | | | |
|---|---|---|---|
| 3002509 | 1/1988 | Japan | 29/895.1 |
| 151837 | 10/1955 | Sweden | 29/895.1 |

*Primary Examiner*—Irene Cuda
*Attorney, Agent, or Firm*—Michael J. Striker

[57] ABSTRACT

A method and a tool for dismounting and mounting a roller ring retained between two flanges of a partition supporting shaft by a pulling anchor with an axial pretensioning in a roller stand simplify and accelerate corresponding operations, since a single tool is used for removing and establishing a pulling anchor pretensioning, screwing in and screwing out and axially displacing the pulling anchor, releasing the roller ring from the flanges and pressing the roller ring against the flanges, during a single setting of the tool.

12 Claims, 2 Drawing Sheets

METHOD OF AND TOOL FOR DISMOUNTING AND MOUNTING OF ROLLER RING

BACKGROUND OF THE INVENTION

The present invention relates to a method and a tool for dismounting and mounting a roller ring.

In known roller ring stands, in particular in the roller stands for rolling of bars and wires, the roller rings are clamped at the end side between two flanges of a partitioned supporting shaft. Both parts of the supporting shaft and thereby its flanges are pressed together by a pulling anchor arranged in the axial region. The pulling anchor is under a high pretensioning in an axial direction. Therefore the roller ring is reliably held by the parts of the supporting shaft and the driving torque is transmitted between the supporting shaft and the roller ring without a relative movement. If such a roller ring is worn out or another caliber opening is needed, the roller ring must be exchanged. The present invention therefore more particularly deals with a method of dismounting and mounting of such a roller ring of a roller stand, which roller ring is held between two flanges of a partitioned supporting shaft by a pulling anchor with an axial pretensioning.

In a known method of this type, a first tool is placed first on the supporting shaft end facing away from the roller ring. The first tool is provided in its interior with a threaded sleeve which must be screwed manually on the pulling anchor and projecting outwardly from the supporting shaft end. This first tool is formed as a hydraulic cylinder-piston unit which is supported on the end surface of the supporting shaft end and on a projection of the threaded sleeve. Under the action of a load with a pressurized medium, the tool pulls through the threaded sleeve on the pulling anchor end, and thereby increases its pretensioning. However, the clamping nut of the pulling anchor is unloaded and can be now released by a manual turning by hand with a mandrel. The pressurized medium pressure of the placed first tool is removed and thereby the pulling anchor is unloaded with released clamping nut from any pretensioning. The placed first tool is removed and a second tool is screwed on the supporting shaft and coupled with it in the longitudinal direction. In contrast to the first tool, the second tool instead of the threaded sleeve has a pressure pin with an end surface pressing against an end surface of the pulling anchor end when the second tool is loaded with pressure of the pressurized medium.

With the released clamping nut, the pulling anchor can be displaced in an axial direction, and with this displacement movement the flange of the partitioned supporting shaft can be released from the end surface of the roller ring, and thereafter the second tool can be screwed from the supporting shaft end. Though the flanges of the supporting shaft are released from the roller ring, the rubber ring cannot be removed in the axial direction, being prevented by the pulling anchor which extends through the inner opening of the roller ring. With a third tool which engages again on the pulling anchor end facing away from the roller ring, the pulling anchor must be unscrewed by turning from each supporting shaft part arranged on the opposite side of the roller ring. Then, in some cases with a fourth tool, the free pulling anchor end can be pulled and thereby the other previously screwed-in pulling anchor end can be pulled out of the inner opening of the roller ring, so that it can be withdrawn in a radial direction from the gap space between the flanges. The mounting of the new roller ring is performed in a corresponding manner, but in accordance with an opposite sequence.

This known method of dismounting and mounting of the roller ring is relative expensive, since it must involve several different tools and extensive manual manipulations which are caused in particular by the multiple connection of the different tools with the supporting shaft ends and the pulling shaft ends or disconnection of the different tools from these ends. As a result, the known method is complicated and time consuming for personnel.

SUMMARY OF THE INVENTION

Accordingly, it is an object of the present invention to provide a method of and a tool for dismounting and mounting of a roller ring of a roller stand which is simpler and faster to perform.

More particularly, it is an object of the present invention to provide a method and a tool, with which the lifting and application of the pulling anchor pretensioning, the screwing out and screwing in as well as the axial displacement of the pulling anchor and the release and pressing of the roller ring from or against the flange can be performed with the same tool during one tensioning. As a result, multiple dismounting and mounting of several different tools from and on the supporting shaft end or the pulling anchor end are eliminated. A greater part of manual work for the personnel is dispensed with and the corresponding time required for such works is saved. The roller ring exchange is performed faster and the stoppage time of the roller stand is substantially shorter, which constitutes an important advantage during frequent exchange of the final cross-section of the rolling product and therefore the roller ring.

It is also an object of the present invention to provide a tool for performing the inventive method, such that the tool can be placed on a supporting shaft end and coupled with the corresponding pulling anchor end. The tool in accordance with the present invention is formed so that it can be coupled with the supporting shaft end and with the pulling anchor end in both longitudinal directions and has a threaded shaft which is driveable in both rotary directions by a motor, displaceable in the longitudinal directions by pressure of the pressurized medium, and coupled with the pulling anchor end. The fixed coupling of the tool both with the supporting shaft end and with pulling anchor end permits a relative movement in the longitudinal direction and in the rotary direction between the supporting shaft and the pulling anchor, as required for the dismounting and mounting of the roller ring. The threaded sleeve which is driveable in both rotary directions also can be screwed on the pulling anchor end and provides screwing in and screwing out of the whole pulling anchor in or from the supporting shaft. Since the threaded sleeve is also displaceable in the longitudinal direction under the action of pressure of the pressurized medium, the same tool can be used for releasing and pressing of the roller ring from or against the flange and a further pulling out or pulling in of the pulling anchor for providing the radial removal or insertion of the roller ring.

It is especially advantageous when an axially displaceable polyhedral pin is arranged in the threaded sleeve concentrically and fixedly with it. The polyhedral pin is spring loaded from a receiving region of the threaded sleeve for the pulling anchor end, is loaded by the pressurized medium in the receiving region and engages in a matching opening in the end surface of the pulling anchor end when it is located in the receiving region of the threaded sleeve. Such a polyhedral pin unloads the thread of the pulling anchor end and the threaded from the torques apply from or in the supporting shaft during releasing and screwing in of the other pulling anchor end. These torques are transferred directly from the polyhedral pin to the pulling anchor when it is pressed into the opening of the end surface of the pulling anchor end. When the pressure medium load is eliminated, the spring biased polyhedral pin is pulled out of the opening in the pulling anchor end surface and a relative rotation between the pulling anchor and the threaded sleeve is performed so that it can be screwed from or onto the pulling anchor. Every time during application or removal of the pressure of the pressurized medium, the polyhedral pin is pressed into the pulling anchor end or pulled from it and thereby determines whether the coupling between the threaded sleeve and the pulling anchor must be fixed or screwing on or unscrewing of the threaded sleeve onto or from the pulling anchor end is possible. The longitudinal movements of the pulling anchor are performed via the threaded sleeve and the pulling anchor end screwed in it. The longitudinal forces which are required for this are transferred from the threaded sleeve, and the forces originate from the pressure of the pressurized medium, with which the threaded sleeve is displaceable in the longitudinal direction. In this way all movements of the pulling anchor and the force transmissions to it are possible, as required by dismounting and mounting of a roller ring.

In accordance with a further embodiment of the present invention, a coupling Sleeve surrounds the supporting shaft end and is provided with locking elements distributed over the periphery. The locking elements are inserted by an axially displaceable locking sleeve which surrounds the coupling sleeve, in a groove or recess of the supporting shaft end and held there. Such a design provides for a fast and reliable coupling of the single tool with the supporting shaft end as well as fast and simple release of the coupling. For this purpose, the locking sleeve must be displaced in an axial direction, which can be performed with small dimensions manually. With great dimensions, it is also possible to axially displace the locking sleeve by pressure of the pressurized medium. No manual force must be applied for coupling or uncoupling of the tool with respect to the supporting shaft end. The locking elements can be formed as pawl-shaped levers in accordance with a further feature of the present invention. It is however also possible to form the locking elements as balls.

It is recommended to provide passages in the coupling and the locking sleeve flush with the peripheral surfaces, so as to reach radially a clamping nut of the pulling anchor and to turn it. The clamping nut must be reachable from outside of the tool so that it can be released or tensioned when the pulling anchor is held by the tool under pulling pressure. For this purpose it suffices to provide a slot-shaped longitudinal opening extending in the peripheral direction in the coupling sleeve and in the locking sleeve. With a passing mandrel, it is possible to engage in radial openings of the clamping nut which are formed in its outer periphery. In contrast, it is also possible to introduce through the passages a ratchet or a motor drive for turning the clamping nut of the pulling anchor.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
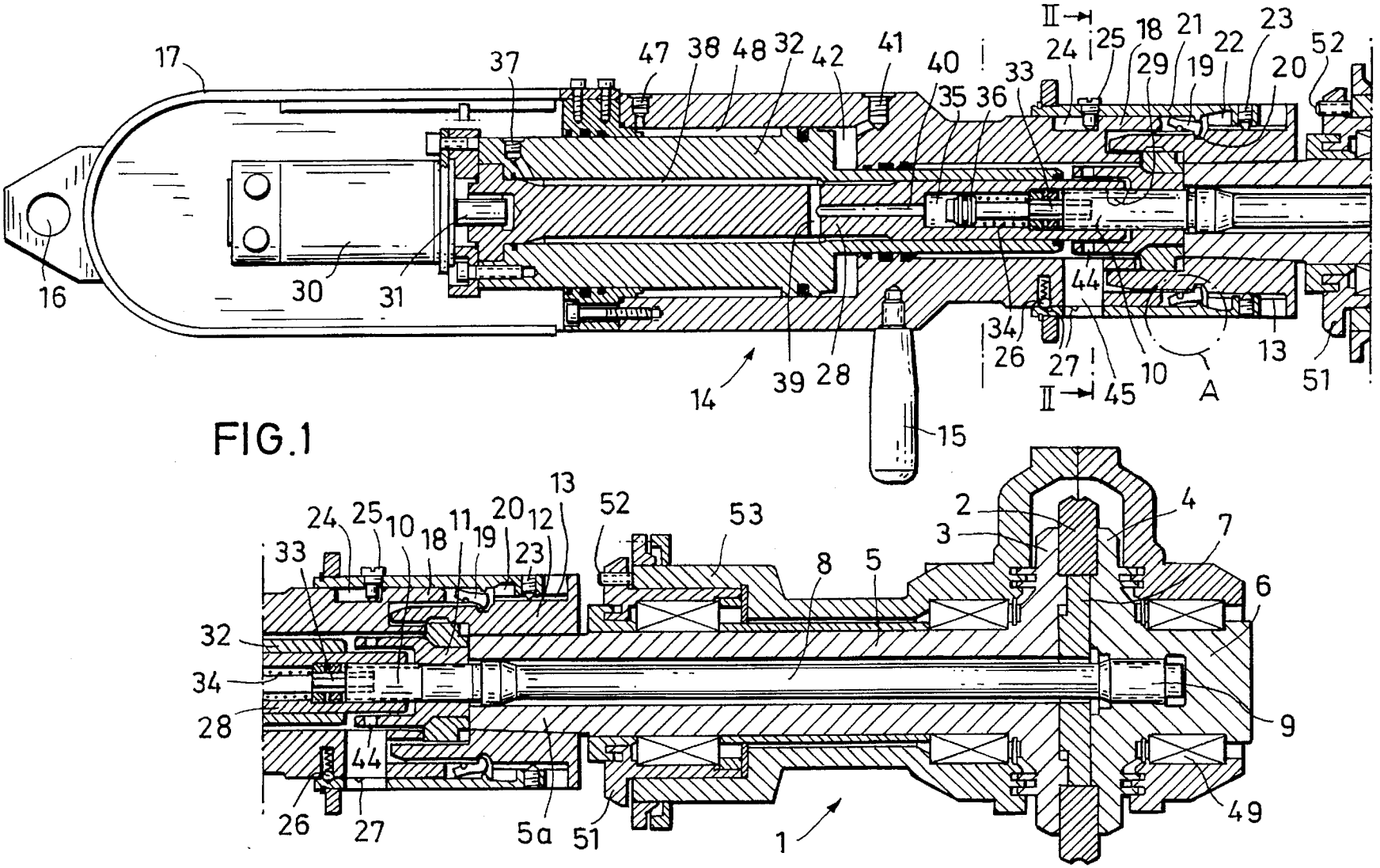
FIG. 1 is a view showing a supporting shaft of a tool in accordance with the present invention in mounted condition, in longitudinal section.

The right part of FIG. 1 shows a roller unit which is conventional for a known roller stand for rolling wires or bars. The whole roller stand is not shown, since it is composed for example of three such roller units assembled in a housing. The subsequent description is also true for other roller units.

The roller unit 1 has a disc-shaped roller ring 2 composed of a high grade material. The roller ring 2 is clamped between flanges 3 and 4 of two supporting shaft parts 5 and 6 of a supporting shaft. The hub region of the roller ring 2 is composed of a cross disc 7 removable from the roller ring 2. Both supporting shaft parts 5 and 6 are firmly clamped with their flanges 3 and 4 by a pulling anchor 8, and the pulling anchor 8 is arranged under high axial pretensioning. The roller ring 2 is firmly held between the flanges 3 and 4 with its pretensioning so that any relative movement between these parts is prevented. The pulling anchor 8 has a threaded end 9 screwed in a threaded opening of the supporting shaft part 6. The other pulling anchor end identified as 10 is also provided with a thread and carries a clamping nut 11 which is supported with pretensioning on the end surface of the supporting shaft end **5*a* of the longer supporting part 5. The supporting shaft end 5*a* also has a coupling member 12 which is fixed on it for joint rotation and is not displaceable in a longitudinal direction but mounted exchangeably. The coupling member 12 has an outer periphery provided with a toothing 13. A not shown sleeve of the drive shaft is fitted on the toothing 13** during operation.

When it is necessary to exchange the roller ring 2 it is performed in a stand factory in which the roller stand is located, after removing the sleeve of the drive shaft from its coupling member 12. In the stand factory, a tool 14 is placed on the coupling member 12 which belongs to the exchangeable roller ring 2, by means of two handles 15 of which one handle is shown in FIG. 1. Suspending of the tool 14 on a suitable supporting device can be performed by a supporting lug 16 at a rear end of a coating 17 of the tool. The tool 14 at its front end is provided with a coupling sleeve 18 which is fitted on the coupling member 12 of the supporting shaft end **5*a*. The coupling sleeve 18 has several locking elements 19 which are distributed on its periphery. As can be seen from FIG. 1, they are formed as pawl-like levers. The locking element 16 engage in a circumferential groove or recess 20 of the coupling member 12 of the supporting shaft end 5*a* and prevents pulling out of the tool 14 from the roller unit 1 when they are held by a locking sleeve 21 in the position shown in FIG. 1**.

The locking sleeve 21 is displaced back to the left in FIG. 1 before displacement of the tool 14 on the roller unit 1. Thereby the locking element 19 can be displaced and in particular into a recess 22. The guiding pins 23 which are distributed on the periphery in the locking sleeve 21 engage, during fitting of the tool 14 onto the roller unit 1, in the toothing 13 of the coupling member 12 and prevent a relative movement between the tool 14 and the roller unit 1. They are coupled with one another non-rotatably and also in the longitudinal direction. The axial displacement is limited by a screw 25 engaging in a slot 24 and prevents the rotation of the locking sleeve 21 relative to the coupling sleeve 18. A spring-loaded ball 27 engaging in depressions 27 prevents an unintentional axial displacement of the locking sleeve 21 and thereby an unintentional coupling or uncoupling with the roller unit 1.

The tool 14 also has a threaded sleeve 28 having a relatively great length and provided with a receiving region 29 with an inner thread only on its front end portion facing the roller unit 1. A pressure medium-operated motor 30 has a drive shaft 31 which is fixedly connected with the opposite end of the threaded sleeve 28 and has a housing screwed on a piston part 32. It provides a rotary movement of the threaded sleeve 28 in both rotary directions, go that its inner thread in the receiving region 29 is screwable on or unscrewable from the pulling anchor end 10 of the pulling anchor 8. The longitudinally displaceable piston part 32 allows the longitudinal displacement of the threaded sleeve 28.

A polyhedral pin 33 extends in the receiving region 29 for the pulling anchor end 10. During screwing on or screwing off of the threaded sleeve 28 relative to the pulling anchor end 10, it is removed by a pressure spring 34 from the receiving region 29 for the pulling anchor end 10. After the screwing on of the threaded sleeve 28 on the pulling anchor end 10, under the action of a pressure medium in a cylinder chamber 35, the rear end of the polyhedral pin 33 formed as a piston 36 and thereby the whole polyhedral pin 33 is inserted in a matching opening in the end surface of the pulling anchor end 10. The pressure of the pressurized medium is supplied through a connection 37 and passages 38, 39, 40 of the cylinder chamber 35. It is provided by an external not shown supply device for the pressurized medium. With the pressed-in polyhedral pin 33, the pulling anchor end 10 is coupled via the inner thread of the receiving region 29 with the threaded sleeve 28 not only in the longitudinal direction, but also in the rotary direction.

Figure 2:
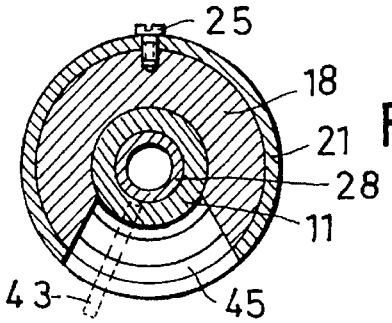
FIG. 2 is a view showing a section taken along line II—II in FIG. 1.

For exchange of the roller ring 2 the tool 14 is displaced with the locking sleeve 21 displaced to the left in FIG. 1, and with the freely movable locking elements 19, onto the coupling member 12 of the supporting shaft end 5*a*. The end surface of the pulling anchor end 10 abuts against the threaded sleeve 28 which is displaced together with the motor 30 and the piston part 32 inside the coupling sleeve 18 as required to the left. When the tool 14 is fitted finally on the coupled member 12 so that the locking elements 19 can engage in the groove or the recesses 20, the locking sleeve 21 is displaced to the right in FIG. 1, so that the locking elements 19 engage in the groove or recesses 20. The guiding pin 23 engages then in the toothing 13 and thereby the tool 14 is coupled both in the longitudinal direction and in the rotary direction with the roller unit 1. By loading of the motor 30 with a pressure medium, the threaded sleeve 28 is screwed with its inner thread onto the pulling anchor end 10 and the roller ring 2 is secured against rotation. Then a cylinder chamber 42 is loaded with pressurized medium through an inlet 41, and the piston part 32 together with it is moved to the left on the threaded sleeve 28. The pulling anchor 8 screwed in the threaded sleeve 28 extends through it. Thereby the clamping nut 11 is released from the end surface of the supporting shaft end 5*a*, it is no longer loaded and therefore can be rotated. The rotation is performed by a mandrel 43 shown in FIG. 2. It extends into openings 44 of the clamping nut 11 and through coinciding passages 48 in the outer surfaces of the coupling sleeve 11 and locking sleeve 21. By means of the mandrel 43, the clamping nut 11 is released so that when subsequently the cylinder chamber 42 is again unloaded the pulling anchor 8 remains free of its pretensioning.

Figure 3:
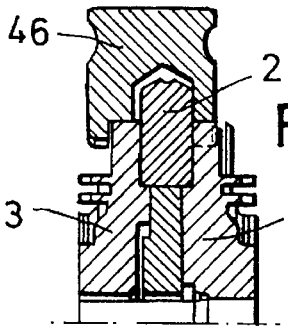
FIGS. 3 and 4 are view showing a part of a roller ring with two different mounted clamps in a longitudinal section.
Figure 4:
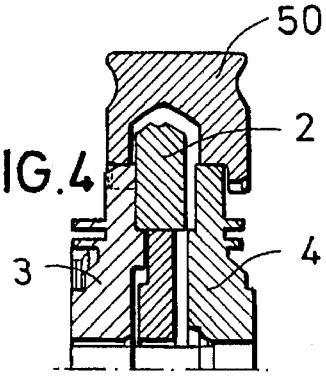
Figure 5:
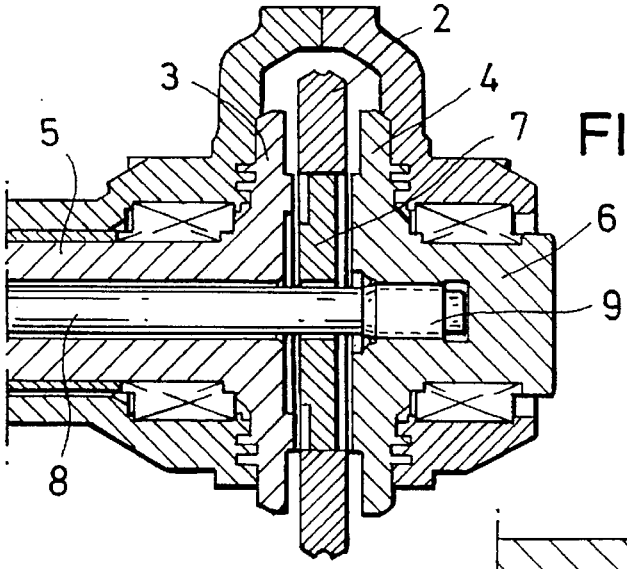
FIG. 5 is a view showing the roller ring with released flanges, in a longitudinal section.

FIG. 3 shows the roller ring 2 in the longitudinal section, as well as the flanges 3 and 4. After unclamping of the pulling anchor 8, a first clamp 46 is fitted on the roller ring 2 and the flanges 3 and 4 from outside and prevents an axial relative movement between the roller ring 2 and the flange 3 but allows the movement relative to the flange 4. After fitting of the first clamp 46, a pressure medium is supplied through an inlet 47 into the cylinder chamber 48. As a result, the threaded sleeve 28 together with the piston part 32, the pulling anchor 8 and through its threaded end 9 also the supporting shaft part 6 and with it the flange 4 are displaced to the right in FIG. 1. This is possible since the bearing identified with reference numeral 49 is formed as a loose bearing and allows the axial movement only to limited extent. When the flange 4 is released from the roller ring 2 as shown in FIG. 4, the first clamp 46 is replaced with a second clamp 50. As can be seen from FIG. 4, the second clamp bridges the free space between the roller ring 2 and the flange 4 and couples these parts with one another without engaging the flange 3. A further movement of the supporting shaft part 6 and the flange 4 to the right activates a release of the roller ring 2 from the flange 3 as shown in FIG. 5. The cylinder chamber 48 is unloaded from pressure of the pressurized medium and arrested against rotation on the supporting shaft part 6. Later the cylinder chamber 35 must be supplied with the pressure medium through the connection 37, so that the polyhedral pin 33 engages in the opening of the end surface of the pulling anchor end 10. The pulling anchor 8 can be turned by the pressurized medium operated motor 30 through the drive shaft 31 and the threaded sleeve 28, and its threaded end 9 is screwed out of the supporting shaft part 6. When this occurs, the cylinder chamber 32 is supplied with the pressurized medium and pulls the pulling anchor 8 in FIG. 1 to the left so that its threaded end 9 releases the roller ring 2 and the cross disc 7. At least the roller ring 2, but also the cross disc 7, can be exchanged. In particular, both parts can be withdrawn in a radial direction from the region between the flanges 3 and 4. After insertion of a new roller ring 2, the pulling anchor 8 is displaced again to the right by unloading of the cylinder chamber 42 and supplying the cylinder chamber 48 with pressurized medium. By actuation of the motor 30 the threaded end 9 is screwed again into the supporting shaft part 6, and the pressure of the pressurized medium in the cylinder chamber 35 is maintained so that the polyhedral pin 33 transfers the occurring torque to the pulling anchor 8. After insertion of the threaded end 9 into the supporting shaft part 6 and switching off of the motor 30, the cylinder chamber 35 can be unloaded, and the polyhedral pin can be pulled back from the pulling anchor end 10 under the action of the pressure spring 34. By loading of the Cylinder chamber 42, the pulling anchor 8 is pulled through the threaded sleeve 28 so that the flanges 3 and 4 abut against the end surfaces of the roller ring 2. Then the cylinder chamber 42 is loaded stronger with the pressure of the pressurized medium and the pulling anchor 8 is provided with the required pretensioning, which is maintained by pulling of the clamping nut 11 by means of the mandrel 43. Then the cylinder 42 is unloaded and the threaded sleeve 28 is screwed from the pulling anchor 8 by the motor 30. Then the tool 14 can be removed from the roller unit 1 or the coupling member 12 of the supporting shaft end 5*a* by displacement of the locking sleeve 21 to the left so that the locking elements 19 are released and the tool 14 is pulled off to the left.

A threaded bushing 51 which has been arrested by a threaded pin 52 before the placement of the tool 14 provides a displacement of the supporting shaft 5 inside its bearing housing 53 in an axial direction and thereby an axial adjustment of the roller ring 2.

Figure 6:
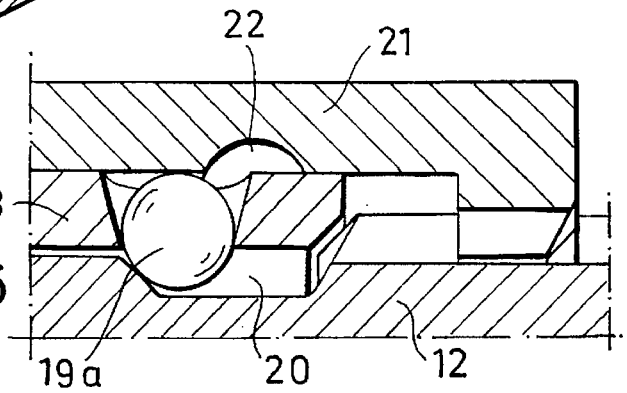
FIG. 6 is a view showing detail A of FIG. 1 in accordance with another embodiment.

As can be seen from FIG. 6, the locking elements 19 can also be formed as balls 19*a*. The balls 19*a* are located in conical openings of the coupling sleeve 18 and secured by the locking sleeve 21 against falling out from the opening. By axial displacement of the locking sleeve 21 relative to the coupling sleeve 18, the balls 19*a* are force into a groove or recesses 20 of the coupling member 12, and securing against unintentional withdrawal of the coupling sleeve 18 from the coupling member 12 is provided. When it is desired, the axial displacement of the locking sleeve 21 causes the displacement of the balls 19*a* into the recess 22 of the locking sleeve 21.

It will be understood that each of the elements described above, or two or more together, may also find a useful application in other types of constructions differing from the types described above.

While the invention has been illustrated and described as embodied in a method of and tool for dismounting and mounting or roller ring, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of dismounting and mounting of a roller ring held between two flanges of a partitioned supporting shaft by a pulling anchor with an axial pretensioning in a roller stand, the method comprising the steps of removing and establishing a pulling anchor pretensioning; screwing out and screwing in as well as axially displacing the pulling anchor; releasing the roller ring from the flanges and pressing the roller ring against the flanges; and performing said removing and establishing, said screwing out and screwing in and said axial displacement, and said releasing and pressing with a single tool during only one setting of the tool.

2. A device for dismounting and mounting a roller ring held between two flanges of a partitioned supporting shaft by a pulling anchor with an axial pretensioning in a roller stand, the device comprising a single tool formed so as to remove and establish a pretensioning of the pulling anchor, to screw out and screw in and axially displace the pulling anchor, and to release the roller ring from the flanges as well as to press the roller ring against the flanges during only one setting of said tool.

3. A device as defined in claim 2, wherein said tool is placeable on a supporting shaft end and coupleable with a pulling anchor end, said tool being coupleable both with said supporting shaft and with said pulling anchor and firmly in both longitudinal directions, said tool being provided with a threaded sleeve which is motor-driven in both rotary directions and is displaceable in said longitudinal direction under the action of pressure of a pressurized medium, for coupling with said pulling anchor end.

4. A device as defined in claim 3, and further comprising a polyhedral pin which is arranged in said threaded sleeve concentrically and also non-rotatably but axially displaceably relative to said threaded sleeve, said threaded sleeve having a receiving region for the pulling anchor end, said polyhedral pin being spring loaded in said receiving region and acted upon by said pressurized medium in said receiving region, said polyhedral pin being engageable in a corresponding opening in an end face of the pulling anchor end when said polyhedral pin is located in said receiving region of said threaded sleeve.

5. A device as defined in claim 3, and further comprising a coupling sleeve arranged to matchingly surround the supporting shaft end from outside and provided with a plurality of locking elements distributed over a periphery; and an axially displaceable locking sleeve which surrounds said coupling sleeve from outside and is arranged so as to insert said locking elements in a recess of the supporting shaft end and holds the locking elements in the recess.

6. A device as defined in claim 5, wherein said locking sleeve is axially displaceable; and further comprising a pressurized medium means operative for axially displacing said locking sleeve.

7. A device as defined in claim 5, wherein said locking elements are formed as pawl-like levers.

8. A device as defined in claim 5, wherein said said locking elements are formed as balls.

9. A device as defined in claim 5, wherein said coupling sleeve and said locking sleeve have outer surfaces provided with passages which coincide with one another; and further comprising a clamping nut provided for the pulling anchor and radially reachable and turnable from outside through said passages.

10. A device as defined in claim 9, and further comprising a mandrel which is engageable through said passages for turning of said clamping nut for the pulling anchor.

11. A device as defined in claim 9, and further comprising a ratchet which is engageable through said passages for turning of said clamping nut for the pulling anchor.

12. A device as defined in claim 9; and further comprising a motor drive which is engageable through said passages for turning of said clamping nut for the pulling anchor.

* * * * *